US007611662B1

(12) United States Patent
Grangruth

(10) Patent No.: US 7,611,662 B1
(45) Date of Patent: Nov. 3, 2009

(54) SWIVEL TIP ATTACHMENT FOR CUTTING TORCH

(76) Inventor: LeRoy M. Grangruth, 11646 Townline Rd., Hibbing, MN (US) 55746

( * ) Notice: Subject to any disclaimer, the term of this patent is extended or adjusted under 35 U.S.C. 154(b) by 0 days.

(21) Appl. No.: 12/178,974

(22) Filed: Jul. 24, 2008

(51) Int. Cl.
*B23K 7/10* (2006.01)

(52) U.S. Cl. ..... 266/77; 266/48; 266/54; 266/70

(58) Field of Classification Search ..... 266/48, 266/54, 70, 77; 148/194, 204
See application file for complete search history.

(56) References Cited

U.S. PATENT DOCUMENTS 2,188,069 A 1/1940 R.E. Walsh
2,492,526 A 12/1949 F.C. Geibig
2,670,789 A 3/1954 C. Dieterich
2,986,624 A * 5/1961 Maria ..... 219/75
4,283,043 A 8/1981 Kalian
4,443,683 A 4/1984 Watts
6,095,801 A * 8/2000 Spiewak ..... 431/344

* cited by examiner

*Primary Examiner*—Scott Kastler
(74) *Attorney, Agent, or Firm*—Altera Law Group, LLC

(57) ABSTRACT

The present invention provides a fully rotatable swivel attachment tip for a cutting torch over a broad radius range. The tip comprises two selectable fixed angle members that, in combination allow orientation of the cutting tip precisely where the operator desires. In addition to the variability of the first and second angles of the first and second angle members, the length of the attachment between the first and second selectable angles may be variable and selectable by the operator to facilitate orientation of the cutting tip and the cutting flame supported and directed thereon. Thus, the cutting tip is thus rotatable along two axes and in two dimensions and is capable of circumscribing a partial sphere of varying diameter.

12 Claims, 2 Drawing Sheets

SWIVEL TIP ATTACHMENT FOR CUTTING TORCH

CROSS-REFERENCE TO RELATED APPLICATIONS

None

BACKGROUND OF THE INVENTION

1. Field of the Invention

The present invention is directed to a swivel tip attachment for a cutting torch, wherein the swivel tip is freely rotatable, without limitation, and wherein the tip may be provided at a plurality of angles to the cutting torch body.

2. Description of the Related Art

The oxyfuel cutting torch is a common device, well known in virtually all areas, including manufacturing, maintenance, automotive repair, railroad, farming, mining and the like. The cutting torch may be used to, among other things, score, gouge, bevel or cut completely through metal. Generally, oxyfuel gas cutting torch's are used to cut iron base alloys. The most common type of oxyfuel gas cutting torch is the oxyacetylene hand cutting torch.

Several common oxyfuel cutting torch methods and arrangements are well known in the industry. Hand-controlled, manual cutting is commonly done in short-run production and one-of-a-kind fabrication settings, as well as in demolition and scrapping operations. Manual cutting may also be used in the field for steel construction. Mechanized or automatic cutting is widely used in production work where a large number of identical cuts are made over and over, or where very precise cuts are required. Mechanized or automatic cutting torches may be amenable to addition of more than one cutting head, allowing for several cuts to be made simultaneously.

Known cutting tips provide attachments to the hand cutting torch that allows for fixed angle of either 75 or 90 degrees relative to the cutting torch body. Additional choices of angles would be desirable. In addition, known tips allow for rotation, but the rotation is limited and do not allow for a full 360 degree rotation. Full rotation would be desirable. The combination of angle selection and full rotation would allow the operator to work in, e.g., confined work spaces, easily reaching work areas not otherwise readily accessible.

The present invention addresses these needs.

BRIEF SUMMARY OF THE INVENTION

The present invention provides a fully rotatable swivel attachment tip for a cutting torch over a broad radius range. The tip comprises two selectable fixed angle members that, in combination allow orientation of the cutting tip precisely where the operator desires. In addition to the variability of the first and second angles of the first and second angle members, the length of the attachment between the first and second selectable angles may be variable and selectable by the operator to facilitate orientation of the cutting tip. Thus, the cutting tip is thus rotatable in two dimensions and is capable of circumscribing a partial sphere of varying diameter.

An object of the present invention is to provide a cutting torch tip that may be used in a narrow space.

Another object of the present invention is to provide a cutting torch tip that comprises a variably orienting and fully rotatable cutting tip.

Another object of the present invention is to provide a cutting torch tip with variable angular orientation and full rotation around two rotational axes in two dimensions so that a partial sphere may be circumscribed of varying diameter.

The figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF THE INVENTION

Figure 1:
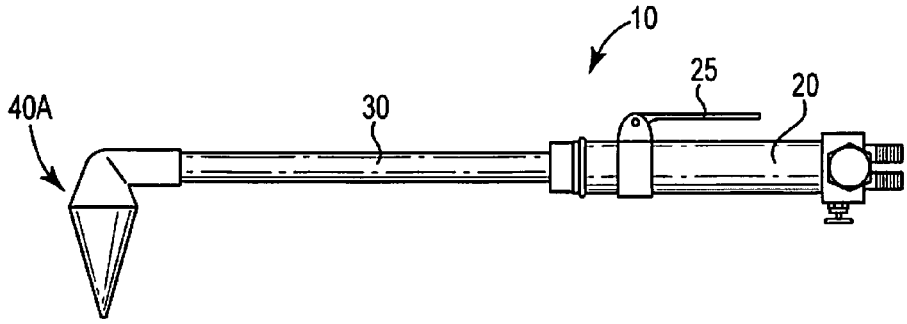
Fig. 1 PRIOR ART
FIG. 1 is a side view of a prior art cutting torch tip.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

Figure 2:
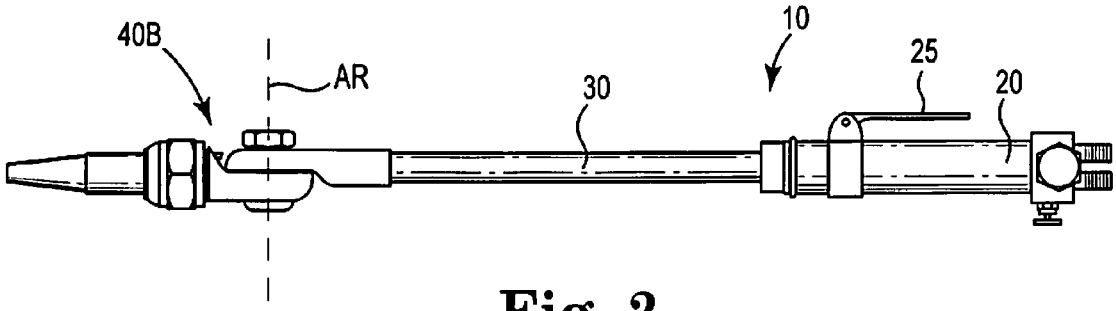
Fig. 2 PRIOR ART
FIG. 2 is a side view of a prior art cutting torch tip.
Figure 3:
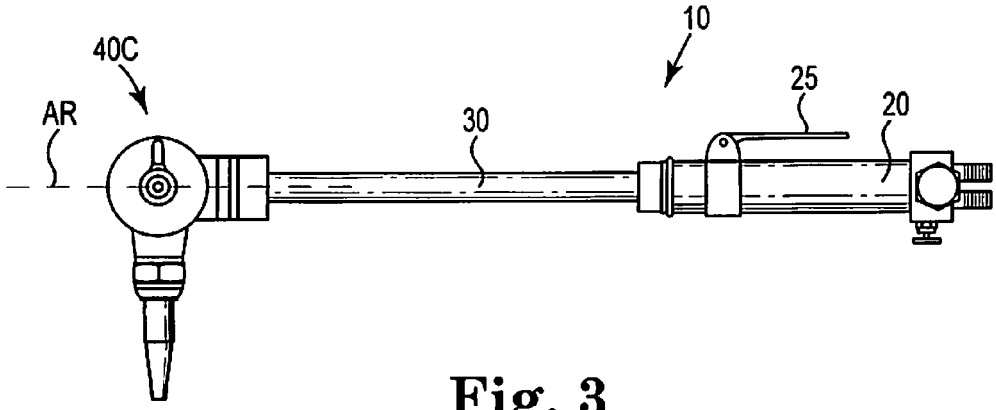
Fig. 3 PRIOR ART
FIG. 3 is a side view of a prior art cutting torch tip.

With reference to FIGS. 1-3, a cutting torch 10 is illustrated having a handle 20, actuating lever 25 for the required gases disposed thereon. The handle 20 is attached to a support member 30. Support member 30 is actually a conduit for the gas lines (not shown) required to initiate the cutting flame, comprising a lumen (not shown) therethrough.

With particular reference now to FIG. 1, a prior art cutting tip 40A is fixedly attached to the support member 30. As illustrated, the prior art cutting tip 40A is fixed at a 90 degree angle to the support member and handle. The prior art cutting tip 40A shown in FIG. 1 lacks an axis of rotation and, as a result, is not rotatable in either any dimension relative to the support member and handle. Alternate prior art cutting tips of this type may also commonly have a fixed 75 degree angle.

Turning to FIG. 2, a second prior art cutting tip 40B is illustrated attached to the support member by virtue of a rotating mechanism. This cutting tip 40B is, however, capable only of one-dimensional rotation with one axis of rotation AR; rotating in a plane that is parallel with the support member 30. However, since the cutting tip 40B occupies, and rotates upon, the same plane as is occupied by the support member 300, this prior art device's one-dimensional rotation cannot comprise a full 360 degree turn. As a further consequence of this prior art one-dimensional rotational design, the cutting flame emitted from the cutting torch tip 40B will necessarily be on the same horizontal plane as the support member 300. Such a tip is disclosed in U.S. Pat. No. 2,188,069 to Walsh. Thus, this prior art device may circumscribe a cutting arc that is coplanar with the support member 30.

FIG. 3 provides a third prior art cutting tip 40C attached to the support member 30. This prior art cutting tip 40C has a single axis of rotation. Thus, this device is rotatable in a single dimension, but in the illustrated case, the rotation is parallel to the support member 30. Such a tip is disclosed in U.S. Pat. No.

2,670,789 to Dieterich. This prior art device may circumscribe a cutting arc that is parallel with the support member 30.

Figure 4:
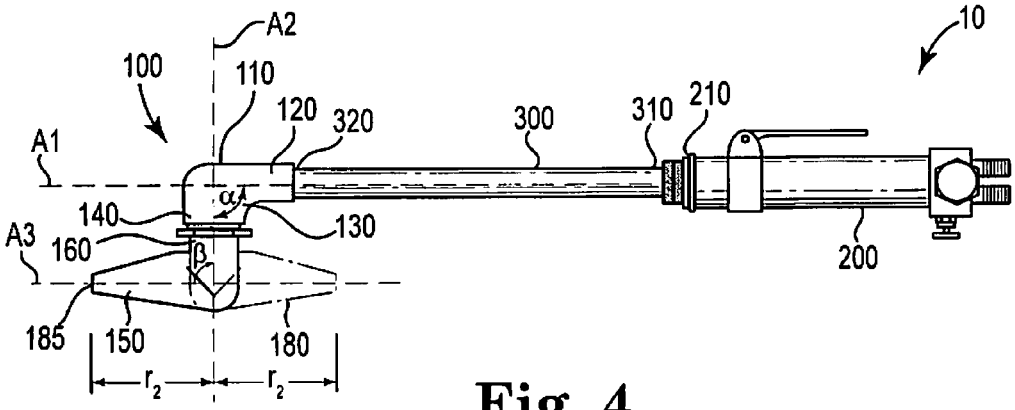
FIG. 4 is a side view of one embodiment of the present invention, illustrating the rotatability of the tip in one dimension in phantom.
Figure 5:
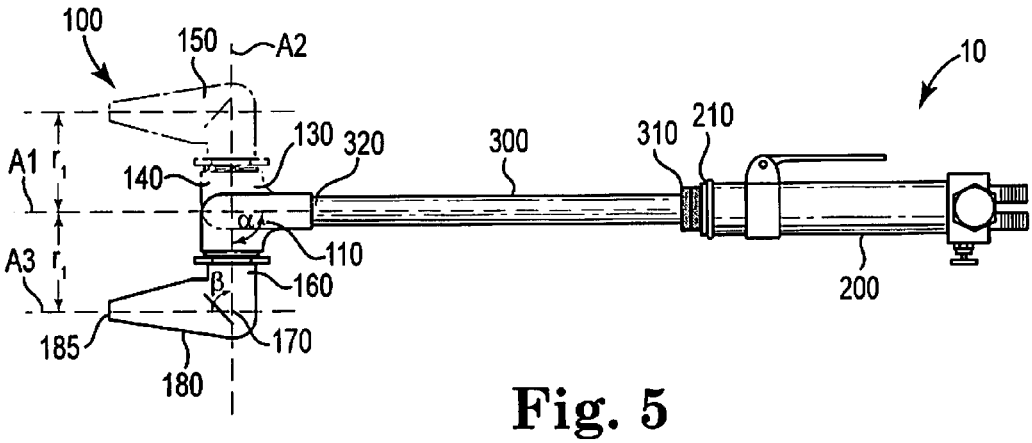
FIG. 5 is a side view of one embodiment of the present invention, illustrating the rotatability of the tip in a second dimension in phantom.

Turning now to FIGS. 4 and 5, one embodiment of the present inventive cutting tip attachment 100 is provided disposed on a cutting torch 10. The handle 200 is shown having a distal end 210. The support member 300 has a proximal end 310 that is fixedly attached to the distal end 210 of the handle 200. The support member's distal end 320 is removably and rotatably attached to the cutting tip attachment 100.

The cutting tip attachment 100 is comprised of a first angled member 110 and a second angled member 150. The first angled member 110 comprises a proximal section 120—which is removably and rotatably attached to the support member 300 by methods well known to those skilled in the art—an angled middle section 130, having exemplary angle $\alpha$, and a distal section 140. The support member 300, proximal section 120, angled middle section 130 and distal section 140 further comprise a lumen (not shown) through which the gases necessary to support and sustain the cutting flame can travel. The support member 300 further comprises a longitudinal axis $A_1$, generally disposed along the center of the lumen and which is the axis of rotation for the first angled member 110. The distal section 140 of the first angled member further comprises an attachment and rotation mechanism well known to those skilled in the art whereby the second angled member 150 may be removably attached and rotated. The length of the proximal section 120 and the distal section 140 may be varied according to the requirements of the particular job as may the angle $\alpha$.

The second angled member 150 comprises a proximal attachment section 160 to which the distal section 140 of the first angled member 110 is removably and rotatably attached as discussed above. Moreover, the second angled member 150 further comprises an angled middle section 170 having exemplary angle $\beta$, and a distal cutting tip section 180 with a cutting tip 185. The proximal attachment 160, angled middle 170 and distal cutting tip 180 sections further comprise a lumen (not shown), in fluid communication with the lumen of the first angled member 110 and support member 300, as discussed above, to support gas flow therethrough for flamed cutting at cutting tip 185. Longitudinal axis $A_2$ generally though the proximal attachment section 160 lumen serves as the rotational axis for the second angled member 150. Cutting tip 185 further comprises a lumen (not shown) and a longitudinal axis $A_3$ therethrough. Angle $\beta$ is thus defined as the angle between longitudinal axis $A_2$ and axis $A_3$.

As discussed above, the proximal attachment section 120 of the first angled member 110 is removably and rotatably attached to the support member 300, allowing the first angled member 110 to rotate about the proximal attachment section's longitudinal axis $A_1$, in one dimension relative to the support member 300, with a fixed radius $r_1$. This is best illustrated in FIG. 5. In this embodiment, the first angled member 110 rotates about the longitudinal axis of the support member $A_1$ with fixed radius $r_1$. The rotation of the first angled member 110 is not limited in any respect in this embodiment. As a result, a full 360 degree rotation about the support member's longitudinal axis $A_1$ may be achieved by the first angled member 110. The length of $r_1$ may be modified by increasing or decreasing the length of the first angled member's distal section 140 and/or the length of the second angled member's proximal attachment section 160. In turn, this increases the translational distance between the distal cutting tip 185 of the second angled member 150 and the support member 300 and its longitudinal axis $A_1$.

As discussed above, the distal section 140 of the first angled member 110 is removably and rotatably attached to the proximal attachment section 160 of the second angled member 150, allowing the second angled member 150 to rotate about a second rotational axis $A_2$ and in a second dimension relative to the support member's longitudinal axis $A_1$ and to the rotation of the first angled member 110. As illustrated in FIG. 4, the rotation of the second angled member 150 causes the second angled member 150 and, in turn, the distal cutting tip 185, to rotate about the proximal attachment section's longitudinal axis $A_2$ with fixed radius $r_2$. The rotation of the second angled member 150, and thus of the distal cutting tip 185, is not limited in any respect as a result of sufficient translational distance, i.e., $r_1$, allowing the distal cutting tip 185 to clear the support member 300. As a result, a full 360 degree rotation may be achieved by the second angled member 150 in the illustrated embodiment. The length of $r_2$ may be modified by increasing or decreasing the length of the distal cutting tip section 180

Thus, the length of the second angled member's proximal attachment section 160 and/or the first angled member's distal section 140 may vary depending upon the requirements of the specific job at hand. By way of example, without limitation, the effect of increasing the length of the proximal attachment section 160 and/or the first angled member's distal section 140 is to increase the distance or translation of the cutting tip, illustrated as fixed radius $r_1$, from the support member 300 and its longitudinal axis $A_1$.

Thus, the individual and collective lengths of the distal section 140 of the first angled member 110 and the proximal attachment section 160 of the second angled member 150 may be variably engineered to obtain the desired radius of rotation $r_1$ for the cutting tip attachment 100 and the cutting tip 185 around the support member's longitudinal axis $A_1$.

The length of radius $r_1$ as well as the spatial orientation of the cutting tip 185 may be further manipulated. In the illustrated embodiment and as discussed above, the first angled member 110 comprises an angled section 130 of $\alpha$, e.g., approximately 90, degrees relative to the support member's longitudinal axis $A_1$. The second angled member comprises an angled section of $\beta$, e.g., approximately 90, degrees relative to the proximal attachment section's longitudinal axis $A_2$. In this embodiment, the cutting tip 185 is thus oriented at approximately 180 degrees, i.e., parallel, relative to the support member's longitudinal axis $A_1$, but translated away from longitudinal axis $A_1$ by distance $r_1$ as discussed above. The skilled artisan will readily recognize that angles $\mu$ and $\beta$ may be greater than or less than the exemplary 90 degrees, depending upon the needs of the particular job. By proper selection of the angles $\mu$ and $\beta$, the operator may spatially orient the cutting tip 185 as needed. Modification of angles $\mu$ and $\beta$ may ultimately modify radii $r_1$ and $r_2$. By way of example, increasing $\mu$ and/or $\beta$ beyond 90 degrees will increase the distance of radius $r_1$ and may, depending upon the angles selected, decrease the distance of radius $r_2$.

Thus, the operator may readily manipulate the cutting tip 185 into desired orientations by making proper selections regarding angles $\mu$ and $\beta$ and radii $r_1$ and $r_2$. As will be understood by those skilled in the art, $r_1$ is a function of $r_2$ and the angles $\mu$ and $\beta$. The skilled artisan will recognize the many potential orientations made possible by the present invention. The combination of rotation along two axes of rotation and in two dimensions, combined with variable manipulability of radii $r_1$ and $r_2$ theoretically enables an operator to circumscribe a sphere with the cutting tip 185 that is nearly complete. The partial sphere is incomplete only because the operator cannot circumscribe the portion of the sphere using the present invention occupied by the support member 300 and/or cutting handle 200. Thus, the fixed angle design requires the operator to cut an arc along the sphere coinciding with a particular cutting tip attachment 100, then remove either the first angled member 110 and/or the second angled member 150 and replace the removed member or members with a configuration required to cut the next arc along the sphere. Moreover, because the distal cutting tip 185 is variably orientable and the radii $r_1$ and $r_2$ may be varied, the sphere that may be circumscribed by the present invention is of varying radius and diameter.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A rotatable cutting tip attachment for a cutting torch, the torch having a handle with a distal end, and a support member having a lumen and longitudinal axis therethrough, a proximal end and a distal end, the proximal end of the support member fixedly attached to the distal end of the handle, the tip attachment comprising:

a first angled member rotatably and removably attached to the distal end of the support member and comprising a fixed angled section and a distal section, the first angled member being fully rotatable about the support member longitudinal axis and selectable in length to circumscribe an arc of variable length radius;

a second angled member comprising a proximal attachment section with a lumen and a longitudinal axis therethrough and a fixed angled section, the proximal attachment section rotatably and removably attached to the distal attachment section of the first angled member, the second angled member being fully rotatably about the proximal attachment section longitudinal axis and selectable in length to circumscribe an arc of variable length radius.

2. The rotatable cutting tip attachment of claim 1, wherein the first angled member's angled section is selectable in degree of angle.

3. The rotatable cutting tip attachment of claim 2, wherein the second angled member's angled section is selectable in degree of angle.

4. The rotatable cutting tip attachment of claim 1, wherein the second angled member's angled section is selectable in degree of angle.

5. The rotatable cutting tip attachment of claim 1, wherein the first angled member further comprises a proximal section, the proximal section rotatably and removably attached to the distal end of the support member.

6. The rotatable cutting tip attachment of claim 1, wherein the second angled member further comprises a distal cutting tip whereon a cutting flame is supported and directed.

7. The rotatable cutting tip attachment of claim 6, wherein the length of the distal cutting tip is selectable in length.

8. The rotatable cutting tip attachment of claim 6, further comprising the cutting tip being translated a selectable distance away from the support member's longitudinal axis.

9. The rotatable cutting tip attachment of claim 8, wherein the spatial orientation of the cutting tip is selectably orientable.

10. The rotatable cutting tip attachment of claim 6, wherein the distal cutting tip circumscribes a partial sphere.

11. The rotatable cutting tip attachment of claim 10, wherein the partial sphere circumscribed is of varying diameter.

12. A rotatable cutting tip attachment for a cutting torch, the torch having a handle with a distal end, and a support member having a lumen and longitudinal axis therethrough, a proximal end and a distal end, the proximal end of the support member fixedly attached to the distal end of the handle, the tip attachment comprising:

a first angled member rotatably and removably attached to the distal end of the support member and comprising a fixed angled section, wherein the fixed angled section is selectable in degree of angle, and a distal section, the first angled member being fully rotatable about the support member longitudinal axis and selectable in length to circumscribe an arc of variable length radius;

a second angled member comprising a proximal attachment section with a lumen and a longitudinal axis therethrough and a fixed angled section, wherein the fixed angled section is selectable in degree of angle, the proximal attachment section rotatably and removably attached to the distal attachment section of the first angled member and a distal cutting tip of selectable length, wherein a cutting flame is supported and directed, the second angled member being fully rotatably about the proximal attachment section longitudinal axis and selectable in length to circumscribe a cutting arc of variable length radius.

* * * * *